United States Patent [19]

Edstrom

[11] 4,320,832

[45] Mar. 23, 1982

[54] CLIP FOR HOLDING SAFETY RAZOR

[76] Inventor: Richard Edstrom, 239 E. 58th St., New York, N.Y. 10022

[21] Appl. No.: 63,759

[22] Filed: Aug. 6, 1979

[51] Int. Cl.[3] ..... B65D 16/00

[52] U.S. Cl. ..... 206/228; 248/230; 248/314

[58] Field of Search ..... 248/37.6, 111, 226.5, 248/229, 230, 300, 314, 539, 145.6; 206/228, 581; 215/100 R, 101; 211/60 A; 220/85 R

[56] References Cited

U.S. PATENT DOCUMENTS

| | | | |
|---|---|---|---|
| D. 206,156 | 11/1966 | Schinker | D17/3 |
| D. 240,681 | 7/1976 | Granatelli | 248/200 X |
| 1,420,297 | 6/1922 | Thompson | 215/100 R |
| 1,992,423 | 2/1935 | Hale | 248/230 X |
| 2,191,782 | 2/1940 | Valane | 248/229 |
| 2,665,103 | 1/1954 | Flora et al. | 248/229 X |
| 2,725,208 | 11/1955 | Bova | 248/214 |
| 2,762,597 | 9/1956 | Jaworski | 248/300 |
| 2,784,578 | 3/1957 | Southwick | 248/145.6 X |
| 3,300,168 | 1/1967 | Gavdino | 248/229 |
| 3,486,630 | 12/1969 | Ellman | 248/300 X |
| 3,807,675 | 4/1974 | Seckerson et al. | 248/226.5 X |
| 3,910,541 | 10/1975 | German | 248/314 X |
| 4,141,445 | 2/1979 | Korich | 206/228 |

FOREIGN PATENT DOCUMENTS

| | | |
|---|---|---|
| 220516 | 8/1924 | United Kingdom . |

*Primary Examiner*—William H. Schultz

*Attorney, Agent, or Firm*—George H. Gerstman

[57] ABSTRACT

A plastic clip is provided for holding a safety razor in association with an aerosol shaving cream container. The clip is formed as a one-piece integrally molded device and has an arcuate portion which is generally resilient for grasping the aerosol shaving cream container. The clip also has a sleeve-like portion extending from the arcuate portion. The sleeve-like portion defines an opening for receiving the handle of a safety razor.

8 Claims, 5 Drawing Figures

CLIP FOR HOLDING SAFETY RAZOR

BACKGROUND OF THE INVENTION

The present invention concerns a novel clip for holding a safety razor, and, more particularly, a plastic clip which serves as a caddy to couple a safety razor to an aerosol shaving container.

The use of shaving cream from an aerosol shaving cream container with a disposable safety razor is extremely common in the United States and elsewhere. Often it is desirable to store the safety razor, for daily use, somewhere adjacent the aerosol shaving cream container. Typically, however, the razor is laid on its side adjacent a sink or in a drawer, separated from the aerosol shaving cream container.

It is an object of the present invention to provide a novel clip for enabling a razor to be coupled to a conventional aerosol shaving cream container.

A further object of the present invention is to provide a razor holding clip which is simple in construction and is easy to manufacture.

A further object of the present invention is to provide a novel clip for a safety razor that has the ability to hold the safety razor in an effective manner and to couple the safety razor to a standard aerosol shaving cream container quickly and simply.

A still further object of the present invention is to provide a novel clip that enables a safety razor to be coupled to an aerosol container and also enables the aerosol container to be spaced from the plane on which it rests.

Other objects and advantages of the present invention will become apparent as the description proceeds.

SUMMARY OF THE INVENTION

In accordance with the present invention, a clip is provided for holding a razor. The clip comprises a plastic member having an arcuate portion with a sleeve-like portion extending therefrom. The arcuate portion has an internal diameter that generally corresponds to the external diameter of an aerosol shaving container.

The arcuate portion is generally resilient to enable it to be snapped onto an aerosol shaving container and retained thereon. The sleeve-like portion extends radially outwardly from the periphery of the arcuate portion and defines an opening having an axis parallel to the axis of the arcuate portion. The opening is adapted to receive the handle of a razor.

In the illustrative embodiment, the clip is formed as a one-piece integrally molded device and the arcuate portion comprises a circular arc of about 270°. The arcuate portion terminates at a pair of opposed ends which define a space for insertion of the aerosol container, with each of the ends carrying a pair of opposed lugs.

A more detailed explanation of the invention is provided in the following description and claims, and is illustrated in the accompanying drawing.

DETAILED DESCRIPTION OF THE ILLUSTRATIVE EMBODIMENT

Figure 1:
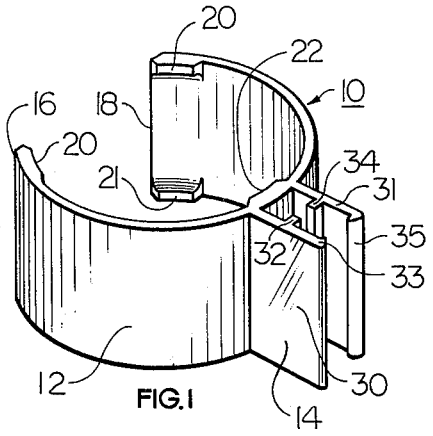
FIG. 1 is a perspective view of a razor holding clip constructed in accordance with the principles of the present invention.

Referring to the drawing, a clip 10 is shown therein having an arcuate portion 12 and a sleeve-like portion 14 extending therefrom. Clip 10 is preferably formed of a generally resilient plastic material in a one-piece integrally molded construction.

Arcuate portion 12 has an internal diameter that generally corresponds with the external diameter of a conventional aerosol shaving cream container to which the clip is to be connected. Arcuate portion 12 terminates in a pair of opposed ends 16,18 which form a space for insertion of the aerosol shaving cream container.

In the illustrative embodiment, the arc formed by arcuate portion 12 is 270°, and the resiliency of the plastic which forms arcuate portion 12 enables the arcuate portion to be snapped around the aerosol shaving cream container.

Figures 3, 4, 5:
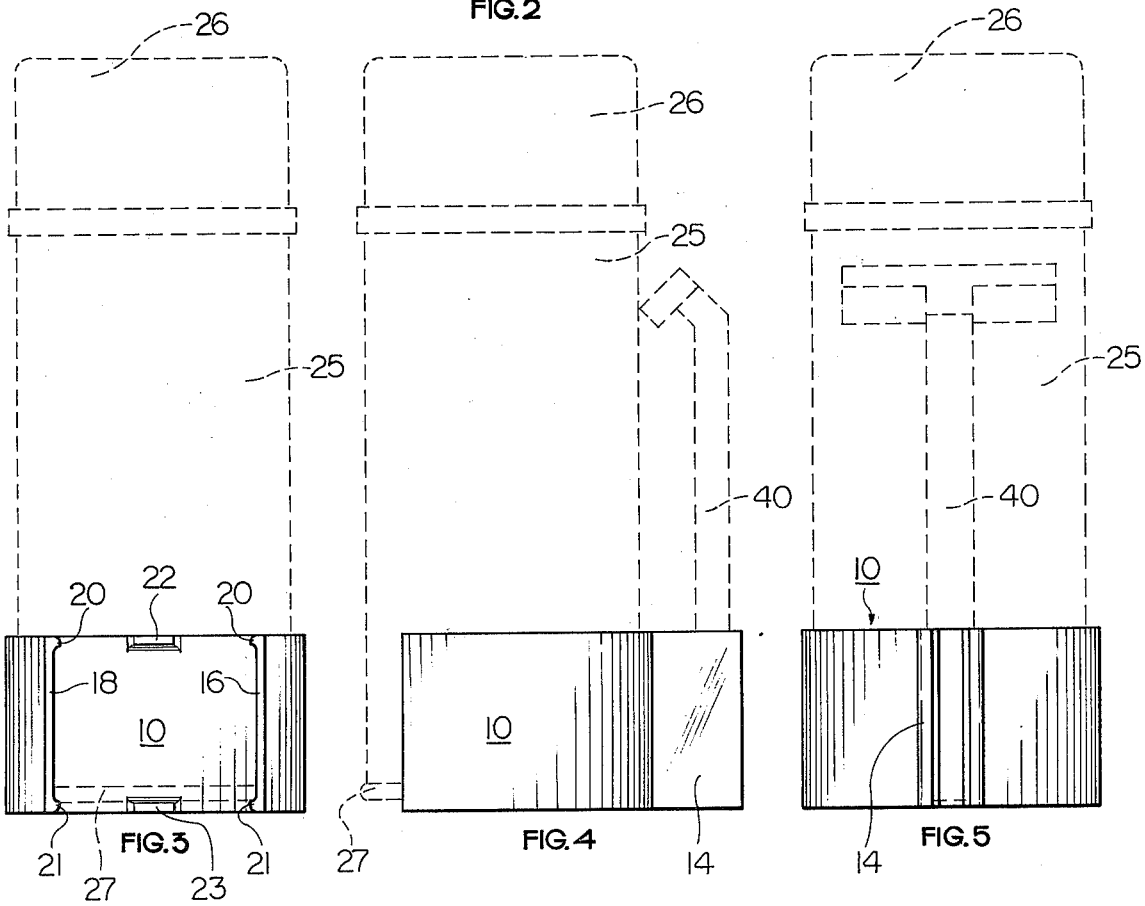
FIG. 3 is a front elevational view thereof, looking into the space defined by the opposed ends of the arcuate portion.
FIG. 4 is a side elevational view thereof.
FIG. 5 is a rear elevational view thereof.

Ends 16 and 18 each carry a pair of opposed lugs 20,21 which are vertically spaced from each other as shown most clearly in FIGS. 1 and 3. A pair of vertically spaced lugs 22,23 is also provided at the bight of arcuate portion 12, with lugs 20–23 serving (a) as pressure fingers to press the clip tightly against the body of the aerosol container, (b) to space the aerosol container from most of the internal surface of arcuate portion 12 and (c) to suspend the container to space it from the plane upon which it is intended to rest.

Thus aerosol shaving cream container 25 is shown in dashed lines, with conventional cap 26 and bottom rim 27. Referring to FIGS. 3 and 4 in particular, it can be seen that bottom rim 27 lies on lugs 21,23 to space the aerosol container from the plane on which it is intended to rest. This aids in preventing rust marks which are sometimes formed when an aerosol shaving cream container rests on a surface for an extended period of time. If desired, however, the clip 10 may be clipped to a different vertical height of aerosol shaving cream container 25.

Figure 2:
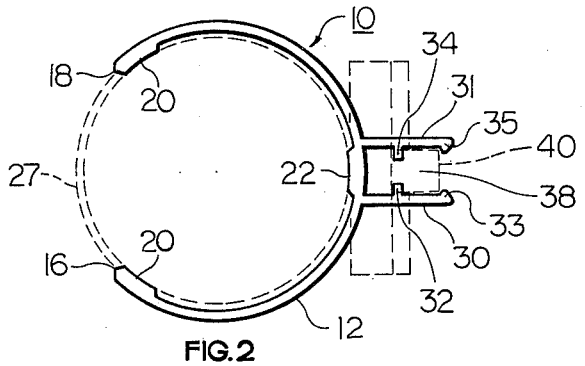
FIG. 2 is a top plan view thereof, showing an aerosol shaving cream container and safety razor in dashed lines.

Sleeve-like portion 14 comprises a pair of arms 30,31 which extend radially outwardly from the bight of arcuate portion 12. Arm 30 has a pair of vertical ribs 32,33 while arm 31 has a pair of vertical ribs 34,35. Vertical ribs 32,34 are generally rectilinear and face each other as seen in FIGS. 1 and 2 and vertical ribs 33 and 35 are triangular-like and face each other as seen in FIGS. 1 and 2. The opening 38 defined by ribs 32, 33, 34 and 35 is generally rectangular and extends parallel to the axis of arcuate portion 12. Opening 38 is adapted for receiving the handle 40 of a safety razor, particularly of the disposable type. The arms 30,31 are dimensioned so that opening 38 is slightly less or equal to the external cross sectional dimensions of handle 40, whereby the handle 40 will be held firmly within opening 38 and will require a snap action in order for the razor to be pulled out of opening 38.

It can thus be seen that the resiliency of the plastic material forming clip 10 enables a snap action with respect to arcuate portion 12 about aerosol shaving cream container 25 and also a snug, snap fit with respect to arms 30,31 about razor handle 40. Ribs 32,34 are spaced from arcuate portions 12 a distance that enables the shaver portion of the safety razor to be directed toward the container 25, as illustrated in FIGS. 4 and 5.

It can be seen that a novel clip has been provided which enables a disposable safety razor to be coupled to an aerosol shaving cream container in a neat and effective manner. Further, the clip can be molded in a one-piece construction, and may be formed of resilient plastic material such as polypropylene in order to provide a snap fit as indicated above.

In the illustrative embodiment, the clip is symmetrical in construction so that it can be connected to the shaving cream container in either of both positions (i.e., with lugs 20 at the top or at the bottom).

Although an illustrative embodiment of the invention has been shown and described, it is to be understood that various modifications and substitutions may be made by those skilled in the art without departing from the novel spirit and scope of the present invention.

What is claimed is:

1. A clip for holding a razor, which comprises:

a member having an arcuate portion with a sleeve-like portion extending therefrom;

said arcuate portion having an internal diameter that generally corresponds to the external diameter of an aerosol shaving container;

said arcuate portion being generally resilient to enable it to be snapped onto an aerosol shaving container and retained thereon;

said arcuate portion terminating at a pair of opposed ends which define a space for inserton of an aerosol container, each of said ends carrying means for spacing the aerosol container from the plane on which it rests; and said sleeve-like portion extending radially outwardly from the periphery of said arcuate portion and defining an opening having an axis parallel to the axis of said arcuate portion, said opening being adapted to receive the handle of a razor.

2. A clip as described in claim 1, said clip being formed as a one-piece integrally molded device.

3. A clip as described in claim 1, said arucate portion comprising a circular arc of about 270°.

4. A clip as described in claim 1, said sleeve-like portion comprising a pair of opposed arms each of which has a pair of spaced vertical ribs extending toward the other arm to form said opening and to space said opening from the periphery of said arcuate portion.

5. A clip as described in claim 4, said opening being spaced from said periphery substantially the width of the head of the razor whose handle is adapted to be received in said opening.

6. A clip for holding a razor, which comprises:

a plastic member formed as a one-piece integrally molded device and having an arcuate portion with a sleeve-like portion extending therefrom;

said arcuate portion comprising a circular arc of about 270° and having an internal diameter that gernerally corresponds to the external diameter of an aerosol shaving container;

said arcuate portion terminating at a pair of opposed ends which define a space for insertion of an aerosol shaving container;

said arcuate portion being generally resilient to enable it to be snapped onto the aerosol shaving container and retained thereon;

each of said opposed ends carrying a pair of opposed lugs for aiding and spacing the aerosol container from most of the internal surface of the arcuate portion and for spacing the aerosol container from the plane on which it rests;

said arcuate portion carrying a further pair of lugs on the internal surface thereof adjacent said sleeve-like portion;

said sleeve-like portion extending radially outwardly from the periphery of said arcuate portion and defining an opening having an axis parallel to the axis of said arcuate portion, said opening being adapted to receive the handle of a safety razor.

7. An aerosol shaving container, safety razor and clip combination, which comprises:

an aerosol shaving container;

a safety razor;

a member having an arcuate portion with a sleeve-like portion extending therefrom;

said arcuate portion having an internal diameter that generally corresponds to the external diameter of said aerosol shaving container;

said arcuate portion terminating at a pair of opposed ends which define a space for insertion of said aerosol container, each of said ends carrying means spacing said aerosol container from the plane on which it rests;

said arcuate portion being generally resilient enabling it to be snapped onto said aerosol shaving container and retained thereon; and said sleeve-like portion extending radially outwardly from the periphery of said arcuate portion and defining an opening having an axis parallel to the axis of said arcuate portion, said opening receiving the handle of said razor.

8. An aerosol container, safety razor and clip combination, which comprises:

an aerosol shaving container;

a safety razor;

a plastic member formed as a one-piece integrally molded device and having an arcuate portion with a sleeve-like portion extending therefrom;

said arcuate portion having an internal diameter that generally corresponds to the external diameter of said aerosol shaving container;

said arcuate portion being generally resilient enabling it to be snapped onto said aerosol shaving container and retained thereon;

said sleeve-like portion extending radially outwardly from the periphery of said arcuate portion and defining an opening having an axis parallel to the axis of said arcuate portion, said opening receiving the handle of said razor;

said sleeve-like portion comprising a pair of opposed arms each of which has a pair of spaced vertical ribs extending toward the other arm to form said opening and to space said opening from the periphery of said arcuate portion, said opening being spaced from said periphery substantially the width of the head of said razor the handle of which is received in said opening.

* * * * *